US011049381B1

(12) United States Patent
Sewell

(10) Patent No.: US 11,049,381 B1
(45) Date of Patent: Jun. 29, 2021

(54) PORTABLE, NETWORK-CONNECTED IRRESPONSIVE ALERT SYSTEM AND METHOD

(71) Applicant: William L. Sewell, Oklahoma City, OK (US)

(72) Inventor: William L. Sewell, Oklahoma City, OK (US)

( * ) Notice: Subject to any disclaimer, the term of this patent is extended or adjusted under 35 U.S.C. 154(b) by 0 days.

(21) Appl. No.: 17/031,153

(22) Filed: Sep. 24, 2020

(51) Int. Cl.
*G08B 21/02* (2006.01)
*G08B 25/10* (2006.01)

(52) U.S. Cl.
CPC ..... *G08B 21/025* (2013.01); *G08B 21/0269* (2013.01); *G08B 21/0291* (2013.01); *G08B 25/10* (2013.01)

(58) Field of Classification Search
CPC ..... G08B 21/025; G08B 21/0269; G08B 21/0291; G08B 25/10
USPC ..... 340/539.13
See application file for complete search history.

(56) References Cited

U.S. PATENT DOCUMENTS 4,196,412 A * 4/1980 Sluis ..... B61L 29/246 340/575
5,012,226 A * 4/1991 Love ..... B60K 28/066 180/272
6,771,163 B2 * 8/2004 Linnett ..... G08B 25/016 340/309.5
7,042,338 B1 * 5/2006 Weber ..... G08B 5/223 340/309.16
9,443,415 B2 * 9/2016 Nepo ..... G08B 15/004

* cited by examiner

*Primary Examiner* — John A Tweel, Jr.
(74) *Attorney, Agent, or Firm* — Michael L. Greenberg, Esq.; Greenberg & Lieberman, LLC

(57) ABSTRACT

A system and method of monitoring and conveying the health status of a user via a device configured to issue an audio-visual cue to the user to which he or she must respond. If the user does not respond to the cue within a specified amount of time, the system contacts pertinent emergency services, employers, and emergency contacts as elected by the user. A wireless communication radio of the system is used to contact the pertinent authorities, and a GPS device is employed to relay location data to expedite the arrival of help to the individual. The system may also be of use in the prevention of kidnapping or lost child scenarios as the system is configured to alert the relevant authorities when no response is detected from the user after a preset period of time has elapsed.

1 Claim, 4 Drawing Sheets

PORTABLE, NETWORK-CONNECTED IRRESPONSIVE ALERT SYSTEM AND METHOD

FIELD OF THE PRESENT INVENTION

The present invention relates to the field of health and safety mechanisms, and more specifically relates to a system and method configured to notify loved ones and/or medical personnel in the event of a non-responsive individual in probable medical distress upon the failure to detect the locality and awareness of one or more individuals which is triggered upon the individual failing to physically respond to an audio-visual cue.

BACKGROUND OF THE PRESENT INVENTION

For many people, reporting to work or school acts as a form of health accountability. If an individual fails to show up for work or school, someone generally notices. Usually, someone such as an employer or teacher will call to check-in on the individual to ensure that he or she is okay, and to determine the reason for the absence. Similarly, a neighbor may check-in on the individual if he or she fails to see the individual arriving or leaving the house for an extended period of time. However, some professions do not have this form of health accountability, and some individuals are rarely home at all to enable neighbors to notice their conscious presence.

For example, truck drivers are not seen going to and from work and are known to essentially live out of the cab of their tractor-trailer. Days or weeks on the road, often with little to no physical interaction with friends, family, neighbors, coworkers, or employers means no one can physically account for the health and awareness of these individuals. While most truck drivers are required to call-in for routing and/or dispatch at least once a day, a large portion of the day leaves them independent, alone, and therefore at risk. This is especially true for individuals with underlying health conditions which may make them susceptible to immobility, unconsciousness, or similar health emergencies.

A multitude of forms of personal safety mechanisms are present on the market which tend to require the user to manually activate the safety device to call for help in the event of a health or safety emergency. Devices such as LifeAlert™ enable the individual in distress to push a button on a nearby or wearable device in order to ask for help. Similarly, OnStar™ provides the same service but is instead mounted inside of the vehicle and is tailored towards vehicle accidents and information requests.

Unfortunately, while these products can be helpful, they only work if the individual manually pushes a button to request help. These products do not help if the user is incapacitated, unconscious, immobile, or deceased, and are unable to detect if the individual is still present at all. Therefore, if the individual is kidnapped or is injured to the point of being non-responsive, these products do nothing.

Thus, there is a need for a new health accountability system which is configured to ensure the mobility and consciousness of the user at regular intervals such that assistance can be provided in the event of a health emergency or kidnapping.

SUMMARY OF THE PRESENT INVENTION

The present invention is a personal safety accountability system and method configured to ensure the health and safety of the user via the issuance of check-ins at regular intervals. As such, the present invention is embodied in a software and hardware solution which enables a network connection, facilitating contact and health accountability for the user with one or more parties. The preferred embodiment of the present invention is primarily configured to act as a form of reverse dead-man switch, in which the user is prompted to manually press a button in response to a cue. The cue is issued at regular intervals, and is configured to act as a mechanism by which the user must physically respond to indicate his or her cognizant and conscious presence.

Software of the system of the present invention instantiates the cue at intervals as selected by the user. The cue is preferably an audio-visual alert which is conveyed via lights and/or an alarm. The alarm may be configured to increase in intensity the longer the alarm continues to ring without response from the user. It is envisioned that the solution provided by the system and method of the present invention may be implemented into a variety of existing hardware devices, including, but not limited to, the infotainment system of a vehicle, a smartwatch, a mobile device, a tablet computer, a smart ring, voice-based digital assistants, or other wearable network-connected devices. Additionally, a stand-alone apparatus, configured with the primary and sole purpose of verifying and ensuring the cognizance, consciousness, and safety of the user may be employed and equipped with the system of the present invention, complete with a button to facilitate response to the audio-visual cue, be available in the event that the user does not wish to implement the system of the present invention on his or her pre-existing devices.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

The present invention is a health and safety alert system and method of use thereof which is configured primarily for use by individuals with existing health conditions, such as those prone to low blood pressure drops, seizures, narcolepsy, and other similar diagnosed health issues which would otherwise render them unresponsive, unconscious, or otherwise incapacitated. As such, the present invention is configured to facilitate the connection of the non-responsive individual to emergency services, as well as to alert his/her family member(s), employer, or other pertinent party in the event of a health emergency. It is similarly envisioned that the system of the present invention may be used for children to help prevent kidnapping.

The system of the present invention employs a cue (10) and alert mechanism (20) which is preferably present on one or more devices proximal to the user. The cue (10) is preferably present in the form of a response button (30) and/or separate light which is shown on a mobile device or a stand-alone product equipped with the software solution instantiating the system of the present invention. It is envisioned that the software solution of the present invention may be configured to be installed on a wide variety of existing mobile devices, including, but not limited to, smartphones, infotainment systems, smart watches, digital audio players, voice-controlled personal assistants, smart rings, smart glasses, and other known digital consumer products.

The system of the present invention is preferably configured by the end user to issue an audio-visual alert via the alert mechanism (20) at regular intervals. The intervals are assigned by the end user, and may range from two to 24 hours, and may be scheduled for different intervals at different times of day. For example, the user may opt to want a cue every two hours to check-in during the day, but every 4 hours overnight to minimize sleep disruption.

Figure 1:
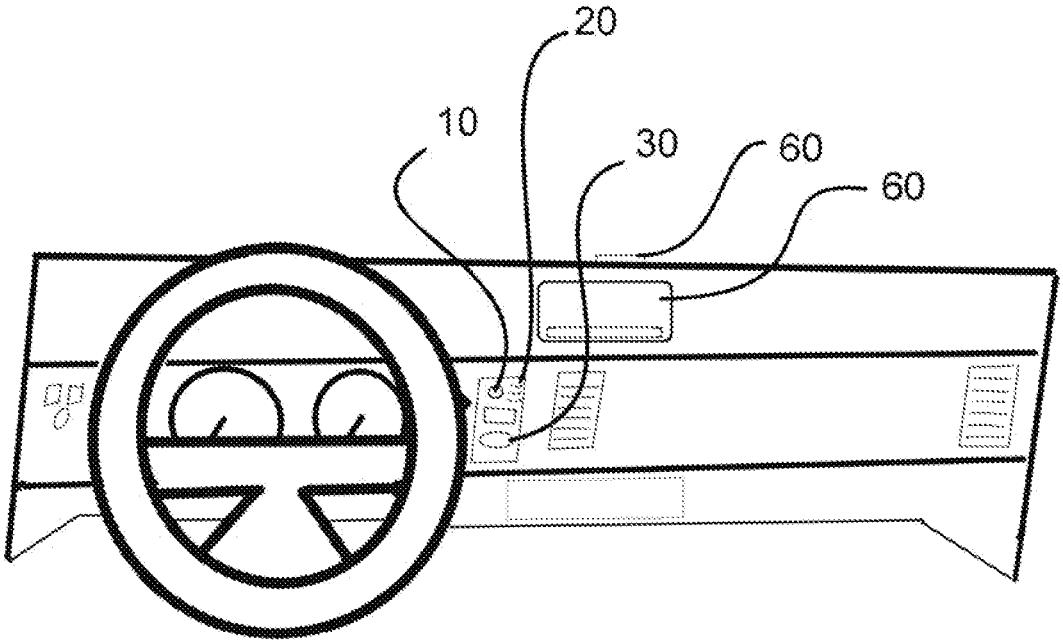
FIG. 1 depicts a view of the apparatus of the present invention as seen from the front, shown on the dash of a vehicle.
Figure 2:
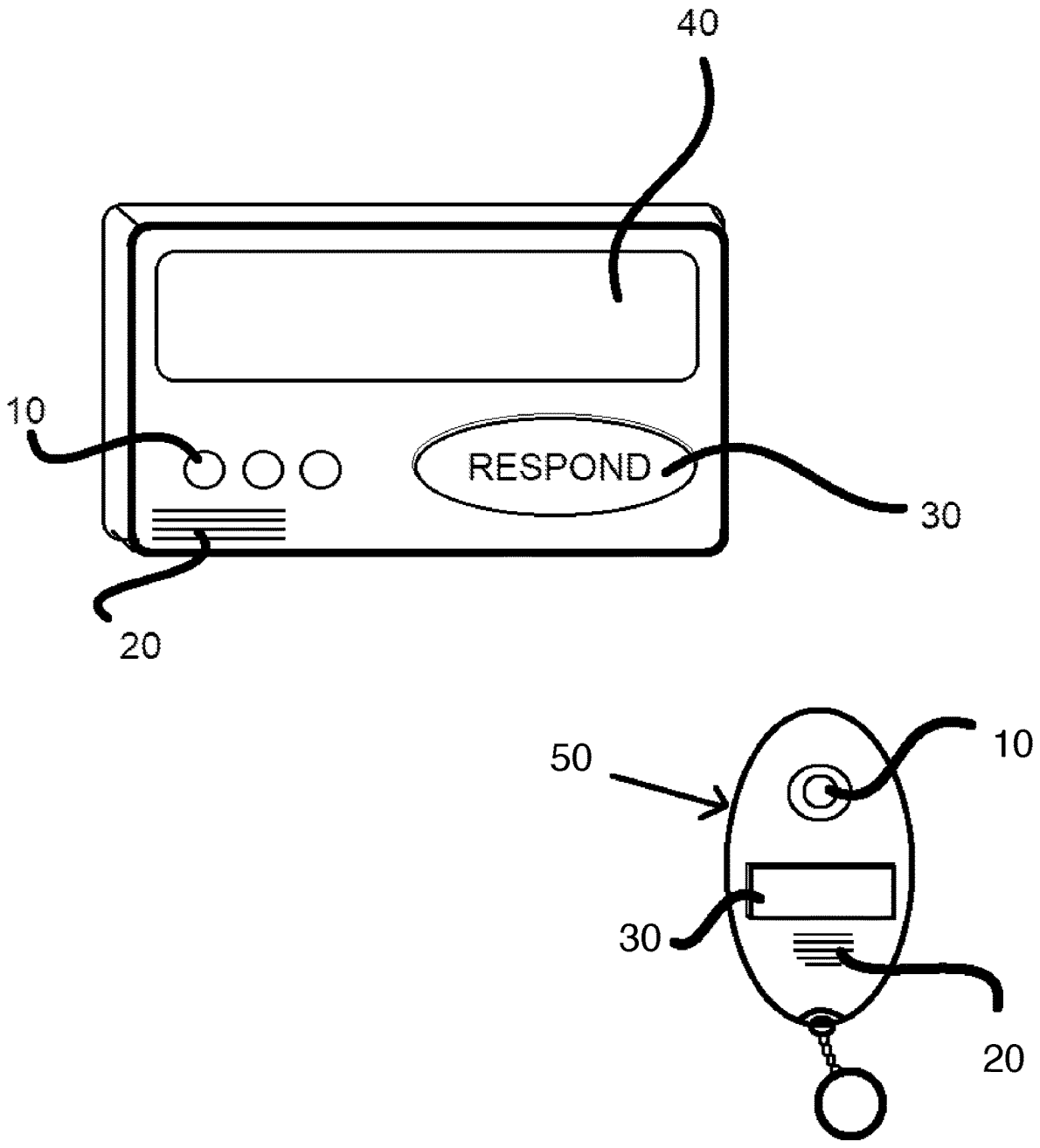
FIG. 2 depicts a view of an alternate embodiment of the present invention, depicting it as a standalone unit to be removably installed within a vehicle, as well as depicting an accompanying wireless key-fob.
Figure 3:
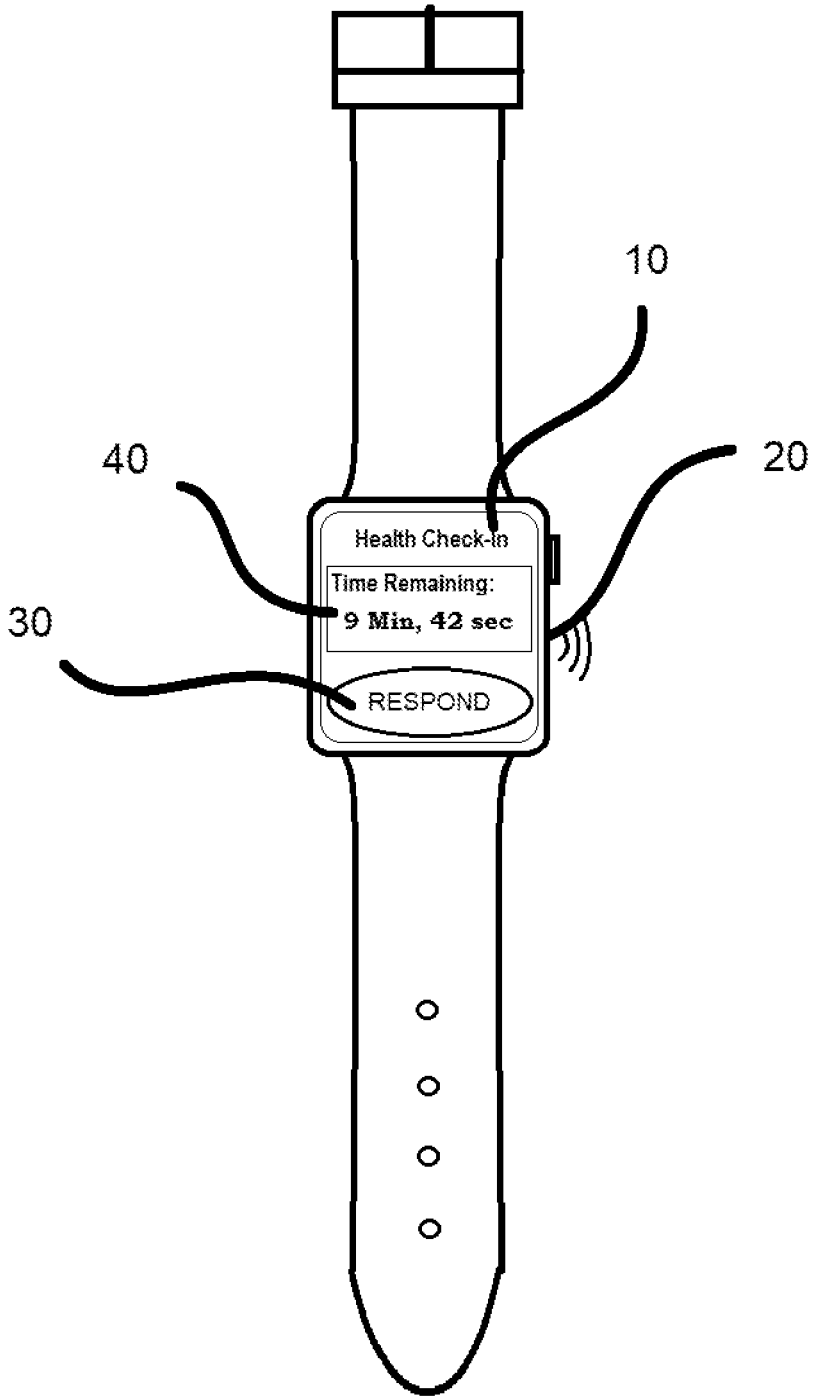
FIG. 3 exhibits a view of the system of the present invention, running as software on a mobile device.

Upon reaching the user-defined interval, the system issues the audio-visual alert (cue) and the response button (30) appears on a screen (40) of the mobile device, or is illuminated on the stand-alone device of the present invention, prompting the user to respond to the cue. The audio-visual alert is configured to sound for a pre-determined amount of time, and may increase in intensity as time without a response continues until the pre-determined time elapses. The pre-determined time is preferably up to 15 minutes to provide for the user to be using the bathroom, pumping gas, getting food, or doing similar break tasks. Upon pressing the response button (30), the audio-visual alert is deactivated, and the interval is reset. The instance of the user pressing the response button (30) is logged, as is the location of the user. This data may be conveyed to a database via a network connection to facilitate tracking of the user's location and health. The screen (40) of some mobile devices may be configured to display a countdown timer as shown in FIG. 3 to indicate how much time the user has remaining to press the response button (30) before assistance or medical personnel is contacted.

In the event that the user does not press the response button (30) within the user-defined time period, a safety communication system is triggered which contacts the user's pre-selected health professional(s) and/or the nearest medical facility to expedite treatment. Additionally, the system may be configured to contact the user's family, friends, employer, or other pertinent party once triggered. It should be understood that there must not be a response to the cue with the selected timeframe in order to activate this system.

Figure 4:
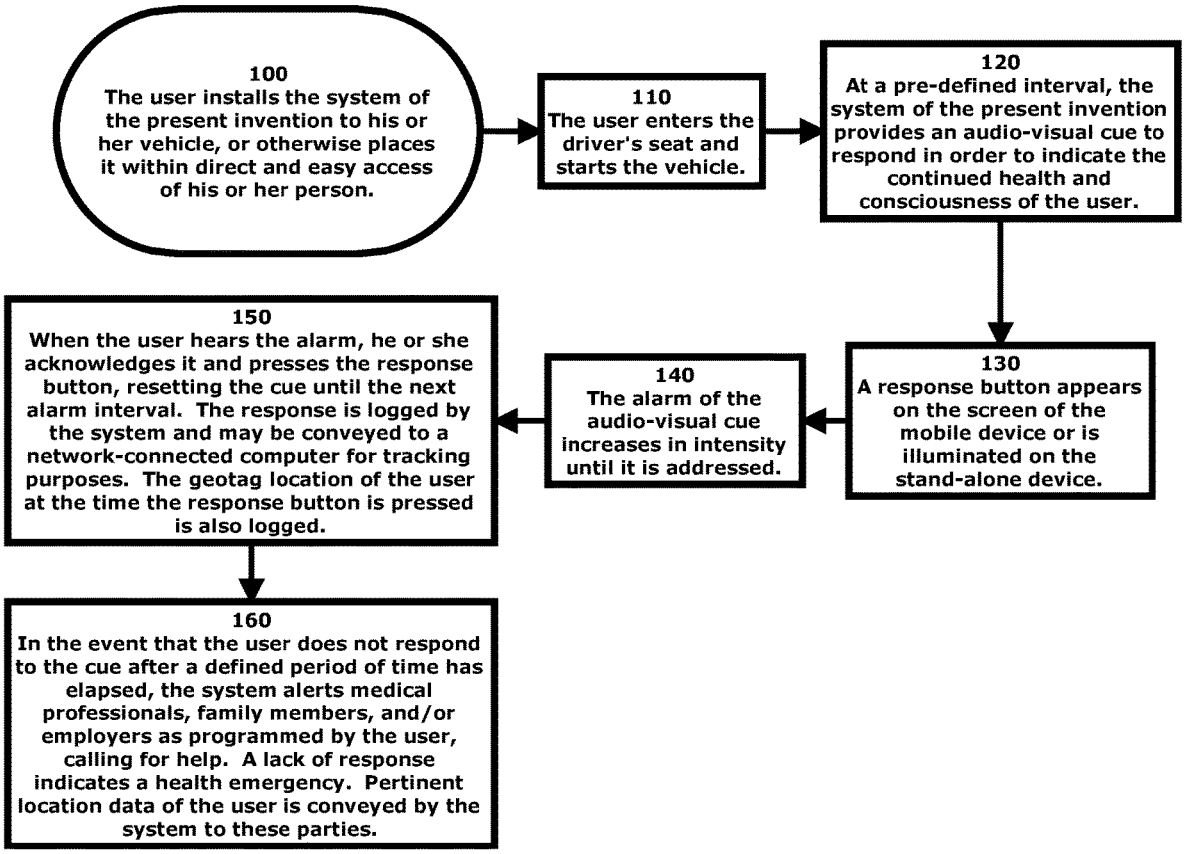
FIG. 4 shows a flow chart detailing the process of use of the system and method of the present invention by a user.

The method of use of the system of the present invention, as shown in FIG. 4, per an example use-case for a truck driver, is preferably as follows:

1. The user installs the system of the present invention to his or her vehicle, or otherwise places it within direct and easy access of his or her person. (100) Alternately, the system may be present as software installed on his or her mobile device, such as a smartphone, tablet computer, smart watch, smart ring, infotainment system, etc.
2. The user enters the driver's seat and starts the vehicle. (110)
3. At a pre-defined interval, the system of the present invention provides an audio-visual cue to respond in order to indicate the continued health and consciousness of the user. (120)
4. A response button appears on the screen of the mobile device or is illuminated on the stand-alone device. (130)
5. The alarm of the audio-visual cue increases in intensity until it is addressed. (140)
6. When the user hears the alarm, he or she acknowledges it and presses the response button, resetting the cue until the next alarm interval. The response is logged by the system and may be conveyed to a network-connected computer for tracking purposes. The geotag location (derived from GPS (60) data) of the user at the time the response button is pressed is also logged. (150)
7. In the event that the user does not respond to the cue after a defined period of time has elapsed, the system alerts medical professionals, family members, and/or employers as programmed by the user, calling for help. A lack of response indicates a health emergency. Pertinent location data of the user is conveyed by the system to these parties. (160)

It should be noted that alternate embodiments of the present invention may be equipped with a wireless key-fob which is configured to communicate with a primary unit of the present invention which is installed within the cab of the vehicle. In such instances, the key-fob may be configured to facilitate deactivation of the alert mechanism in the event that the user is away from the vehicle for an extended period of time, such as a bathroom break, dinner, an overnight in a hotel, or similar extended situation. In such cases, the user may opt to carry the key-fob and deactivate the alert via an integrated response button present on the key-fob, which would then relay the response to the primary unit wirelessly to indicate that the user is safe.

Alternately, the system and apparatus of the present invention is preferably equipped with a "snooze" feature which facilitates a delay on the sounding of the alert for a preset amount of time to provide for the user to go to the restroom if the need should arise during or near the time of the next upcoming alert.

Similarly, some embodiments of the present invention are preferably equipped with a silent alert switch which, when activated, indicates distress of the individual without sounding an audible alarm. When activated, the silent alert switch will contact pertinent authorities automatically for help, and relay the position of the user to the authorities. Such a silent alert switch may be embodied in a wearable or mobile device, or may be incorporated into the aforementioned key-fob.

Additionally, it should be noted that while the preferred embodiment of the present invention is oriented towards usage in the transportation and logistics industry, some embodiments of the present invention may be tailored for use for children to prevent child abduction, or to help protect the elderly with chronic or underlying health conditions. In such usage scenarios, the child or elderly individual would be outfitted with the apparatus of the present invention as a wearable such as a smartwatch, or with a standalone device equipped with the software of the present invention which may be worn on the waist, neck, wrist, or in the pocket of the user. The apparatus would then issue a cue (10) via the alert mechanism (20) (lights and sound) which would continue to sound and flash until the user activates the response button (30). If the response button (30) is not pressed within a specific amount of time, the system of the present invention then automatically calls for help and relays the location of the user to the pertinent authorities.

It should be noted that, in standalone embodiments of the present invention, a PLC or similar logic controller is preferably employed to manage wireless connections to facilitate communication with emergency services for help. Similarly, a processor coupled to memory may be used to manage the functionality of the present invention. It should be understood that the preferred embodiment of the present invention employs the hardware of mobile devices which are already equipped with such features.

It should be understood that the preferred embodiment of the present invention is preferably configured to be constantly powered, and as such, does not power-down when the ignition of the vehicle is turned to the 'off' position. Additionally, it should be noted that the present invention may be configured to distinguish between AM/PM, and therefore a generic "sleep time" may be set, during which time the system is not configured to issue a cue (10).

It should be noted that some alternate embodiments of the present invention may be configured to connect to a companion device (50) to facilitate the user's response to the cue (10) via a remote operated response button (30) disposed on the companion device (50). Such a companion device (50) is useful in instances in which the device of the present invention is integrated into a vehicle, and as such may not be removed from the vehicle. Therefore, when the user ventures away from the vehicle, such as to get food, sleep outside of the cab, or use the restroom, he or she would be otherwise unable to respond to the cue (10) without a companion device (50). Some embodiments of the companion device (50) may be equipped with a cellular radio to facilitate a wireless internet connection to enable long-distance communication with the primary device disposed within the vehicle.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A health alert and emergency response method for the safeguarding of a user comprising:

a device executing computer code via a programmable logic controller (PLC) configured to perform the following:

displaying on a display screen of the device a cue, the cue indicating a request for a response;

illuminating a response button;

issuing an audio-visual alert via a speaker and at least one light and starting a count-down timer;

the user noticing the audio-visual alert;

the user pressing the response button prior to the count-down timer reaching zero;

upon failure of the user to press the response button prior to the count-down timer reaching zero, the device executing computer code via the PLC to perform the following:

activating a wireless communication radio of the device;

communicating to at least one emergency service to indicate a lack of response from the user;

activating a GPS unit of the device;

relaying geolocation data to the at least one emergency service to indicate the location of the user; and the device saving the date, time, and location of the failed response;

wherein the lack of response from the user indicates distress;

wherein the device is integrated into an infotainment system of a vehicle;

the user venturing away from the vehicle equipped with the device for over 15 minutes; and the user bringing a companion device equipped with a response button, the companion device configured to interface with the device wirelessly to facilitate a response by the user to the cue while away from the device.

* * * * *